US005429055A

United States Patent [19]

Schneuing et al.

[11] Patent Number: 5,429,055

[45] Date of Patent: Jul. 4, 1995

[54] DRIVE ELEMENT FOR THE LOAD CARRIER OF AN OVERHEAD CONVEYOR SYSTEM

[75] Inventors: Ralf Schneuing; Klaus Niesen; Gerhard Schilling, all of Bielefeld, Germany

[73] Assignee: Durkopp Adler Aktiengesellschaft, Germany

[21] Appl. No.: 169,671

[22] Filed: Dec. 17, 1993

[30] Foreign Application Priority Data

Dec. 24, 1992 [DE] Germany ..... 42 44 154.4

[51] Int. Cl.[6] ..... B61J 3/04

[52] U.S. Cl. ..... 104/172.4; 164/162; 198/719

[58] Field of Search ..... 104/162, 172.1, 172.4, 104/172.5; 198/465.4, 719

[56] References Cited

U.S. PATENT DOCUMENTS

| | | | |
|---|---|---|---|
| 3,418,949 | 12/1968 | Hans-Georg-Fromme et al. | 104/172.5 |
| 3,907,097 | 9/1975 | Ziegelmeyer | 198/719 |
| 4,388,990 | 6/1983 | Michalik | 198/719 X |
| 4,927,002 | 5/1990 | Springman | 198/719 X |

FOREIGN PATENT DOCUMENTS

| | | |
|---|---|---|
| 2077989 | 10/1971 | France . |
| 1137685 | 10/1962 | Germany . |
| 457260 | 2/1967 | Switzerland . |
| 962477 | 10/1961 | United Kingdom . |
| 1046597 | 10/1966 | United Kingdom . |

*Primary Examiner*—Robert J. Oberleitner
*Assistant Examiner*—S. Joseph Morano
*Attorney, Agent, or Firm*—Ostrolenk, Faber, Gerb & Soffen

[57] ABSTRACT

A drive element for rail-guided load carriers of an overhead conveyor system in which the driver, which is mounted on the drive element via a hole, has a horizontal groove which extends outward from the hole. Too high a horizontal force acting on the driver causes the drive to be pulled off of the pin. Thus, the drive element which is continuously driven via a drive chain can travel past a conveyor carriage which is blocked in the direction of conveyance without the drive element or the conveyor carriage being destroyed. In order to prevent a driver that has been pulled off of the pin from doing any damage, it is secured via a wire bow which is inserted into a continuous hole provided on the driver. If the overhead conveyor system is developed with branches and a pusher is arranged on the conveyor chain behind each conveyor carriage for pushing the conveyor carriage onto a branch, the pusher claw can be developed in the same way as the driver.

16 Claims, 3 Drawing Sheets

DRIVE ELEMENT FOR THE LOAD CARRIER OF AN OVERHEAD CONVEYOR SYSTEM

CROSS-REFERENCE TO RELATED APPLICATION

This application is related to a commonly assigned application filed on even date herewith and titled "Overhead Conveyor System Having A Pusher Device With Overload And Blockage Protection" (Ser. No. 08/168,845), the disclosure of which is expressly incorporated by reference.

BACKGROUND OF THE INVENTION

The present invention relates to a drive element for a load carrier of an overhead conveyor system, and more particularly to a drive element for driving rail-guided load carriers of an overhead conveyor system which travel on rollers, particularly for driving a single-track conveyor carriage provided with articles of clothing hanging on hangers.

In a conventional overhead conveyor system, a drive element is fastened to a conveyor means (a drive chain) extending above a runway rail and parallel thereto. The conveyor means has a driver which, in its active position, acts during the transport for the transmission of force to the load carriers and is pivoted to the drive element by means of a horizontal pin in a hole provided the drive element. The driver is swingable out of its active position in the direction of transport (T) and is substantially rigid in the direction opposite the direction of transport (T).

In particular in the clothing industry, the articles of clothing suspended from clothes hangers are hung, for purposes of filling orders or removal, on the carrier rod of the single-track conveyor carriages, so-called trolleys, of an overhead conveyor system. Each of the trolleys, which travel on rails, is pushed by a driver which acts on the front track roller. The driver is developed on a drive element which, in its turn, is fastened on the drive chain which is arranged above the runway rail.

In order for a trolley to be properly transported, the driver must be rigid in the direction of transport. However, in order to be able also to pass by the trolley, the driver is swingable in the direction of transport and can thus be moved over the rollers of the trolley when a trolley is not being transported.

In this connection, it is known to fasten the driver, which is formed of plastic, to the drive element by means of a pin which is passed horizontally and eccentrically through one end of the driver. By this asymmetrically arranged axis of swing of driver, the swingability permissible in only one direction is obtained.

If a trolley in the conveyor line is unintentionally prevented from traveling further by coming against an obstacle, for instance, or by the rear track roller by error leaving the track at a switch while the front track roller continues to remain in the conveyor line, then either the drive element, the driver, or even the entire conveyor system will be inescapably damaged since the drive chain rotates continuously.

SUMMARY OF THE INVENTION

The present invention improves over prior a drive element such that irreversible damage is prevented in the event that the transport path for the conveyor carriage is blocked.

Accordingly, the present invention has a drive element wherein the driver is provided having a hole on its end with a slot which extends parallel thereto and extends into the hole.

The slot or groove, which extends, at the end of the driver, parallel to the hole and into it, permits the driver to be pulled off of the pin when acted upon by a strong force in opposition to the direction of conveyance, the force being sufficient to press the pin through the slot. The drive element can then travel unimpeded over a blocked trolley.

Preferably, in the active position of the driver, a groove faces the drive element, and the pivot point for the lifting of the driver is away from the axis of the hole.

According to another advantageous feature, the driver is secured to the drive element by a wire bow, the wire yoke serving as a safety attachment. It is thus assured that a driver which flies off of the drive element cannot do any damage to the surroundings but, rather, is held secured to the drive element.

Other features and advantages of the present invention will become apparent from the following description of the invention which refers to the accompanying drawings.

DETAILED DESCRIPTION OF AN EMBODIMENT OF THE INVENTION

Figure 4:
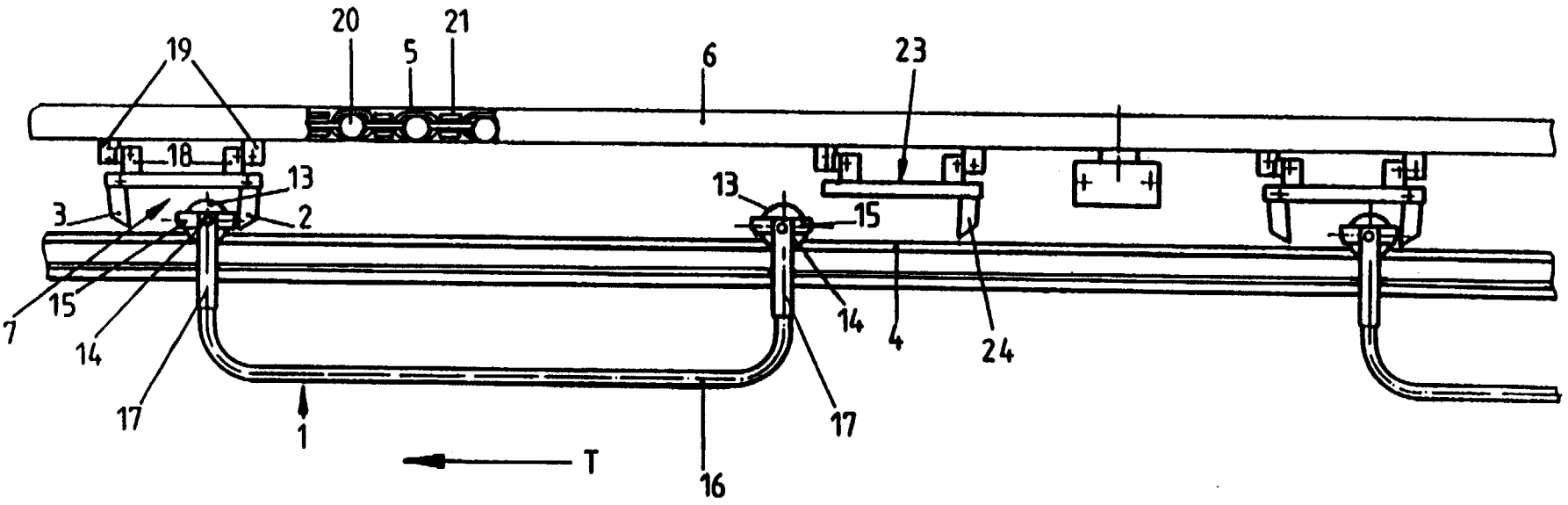
FIG. 4 is a schematic diagram of a conveyor system.

Referring to FIG. 4, a conveyor carriage 1 includes a carrier rod 16 which is bent in a U-shape and is mounted turnably at both its ends in track-roller supports 17. Each track-roller support 17 supports a shaft 14 of a track roller 13. Around each track roller 13 is provided a bumper cap 15 which is urged in the direction of travel T by a driver 2, made preferably of plastic, of a drive element 7. Track-roller support 17, track roller 13 and bumper cap 15 are of identical development for the front and rear ends of the trolley and therefore have been provided with the same reference numerals in the drawing.

Articles of clothing hanging, for instance, from clothes hangers, are suspended from the carrier rod 16 of the conveyor carriages 1 and are transported from the place of production to the storage area.

The overhead conveyor shown diagrammatically in FIG. 4, comprises a chain channel 6 and a runway rail 4 which has a profile which is conventional and therefore is not shown in detail, and on which rail travel conveyor carriages 1, so-called trolleys, which are load-supporting hangers. Within the chain channel 6, a three-dimensionally articulated drive chain is guided by carrying and support rollers 20, 21, said chain being driven continuously in revolution by a conventional gear motor, not shown.

Drive element 7 is fastened to drive chain 5, in each case, in the region of two adjacent support rollers 20 on support brackets 19 which extend downward out of the chain channel 6. On the front end of the drive element, as seen in the direction of transport T (to the left in the drawing) there is arranged a brake claw 3 which protrudes downward in the direction of runway rail 4, while at the opposite end of drive element 7, a downward-extending driver 2 is arranged.

Figure 2:
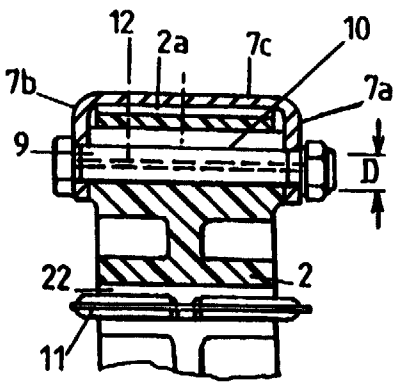
FIG. 2 is a partial cross-sectional view taken along line 2—2 in FIG. 1 of a drive element of the present invention at the height of the driver.
Figure 1:
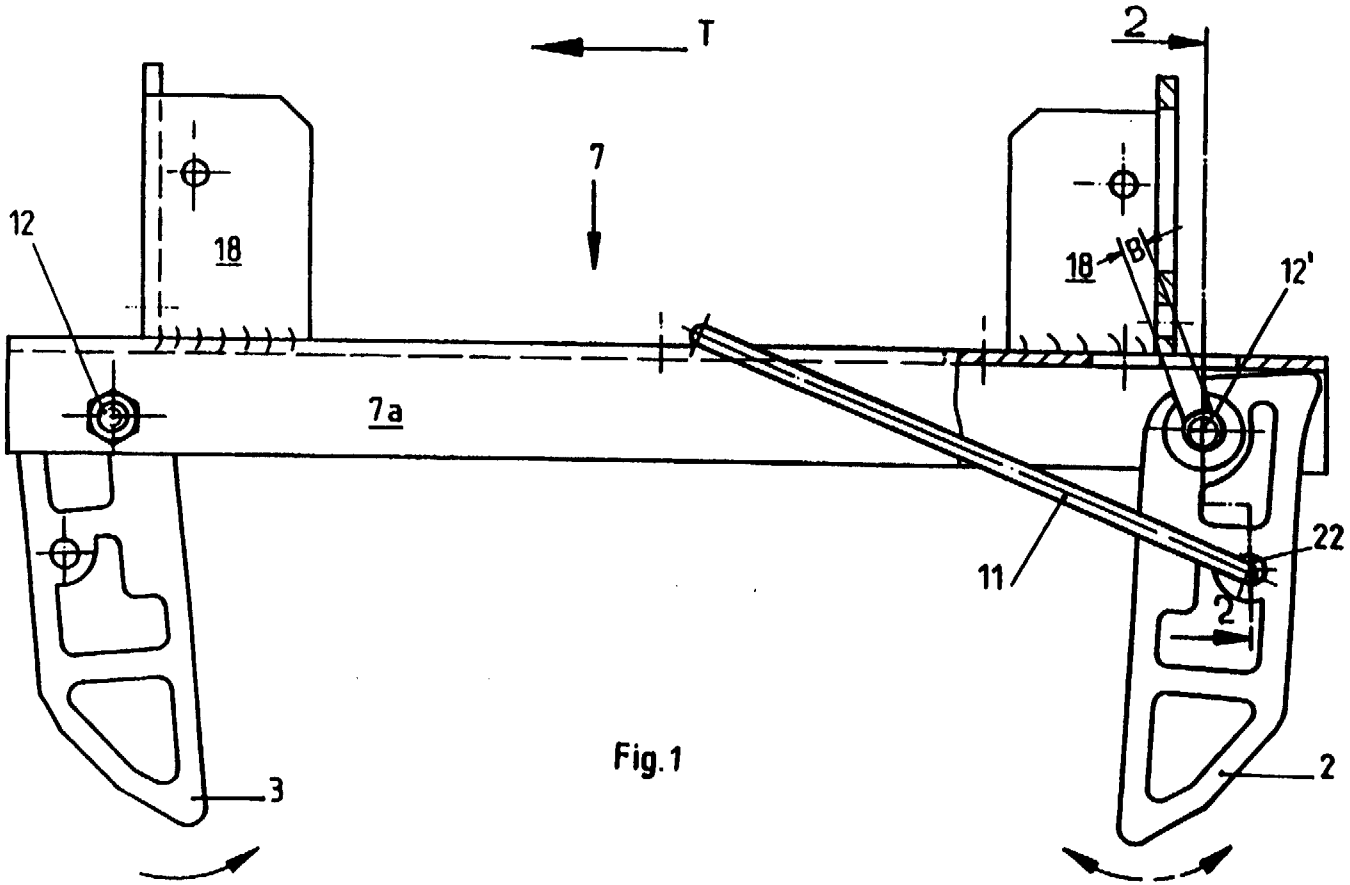
FIG. 1 is a partial cross-sectional view of a drive element according to the present invention.

Referring to FIG. 1, brake claw 3 and driver 2 are mounted for swinging in opposite directions via pins 12, 12' in upside-down flanges of the U-shaped drive element 7 (see FIG. 2). Drive element 7 is connected to carrier brackets 19 (FIG. 4) by a carrier yoke 18. Upon conveyance on a horizontal path or in the case of ascending travel, driver 2 acts on the front bumper cap of conveyor carriage 1 (FIG. 4) and thereby pushes it forward with the speed of the revolving conveyor chain 5. In descending travel, the front bumper cap 15 of conveyor carriage 1 strikes against brake claw 3 and is thereby prevented from rolling away.

Figure 3:
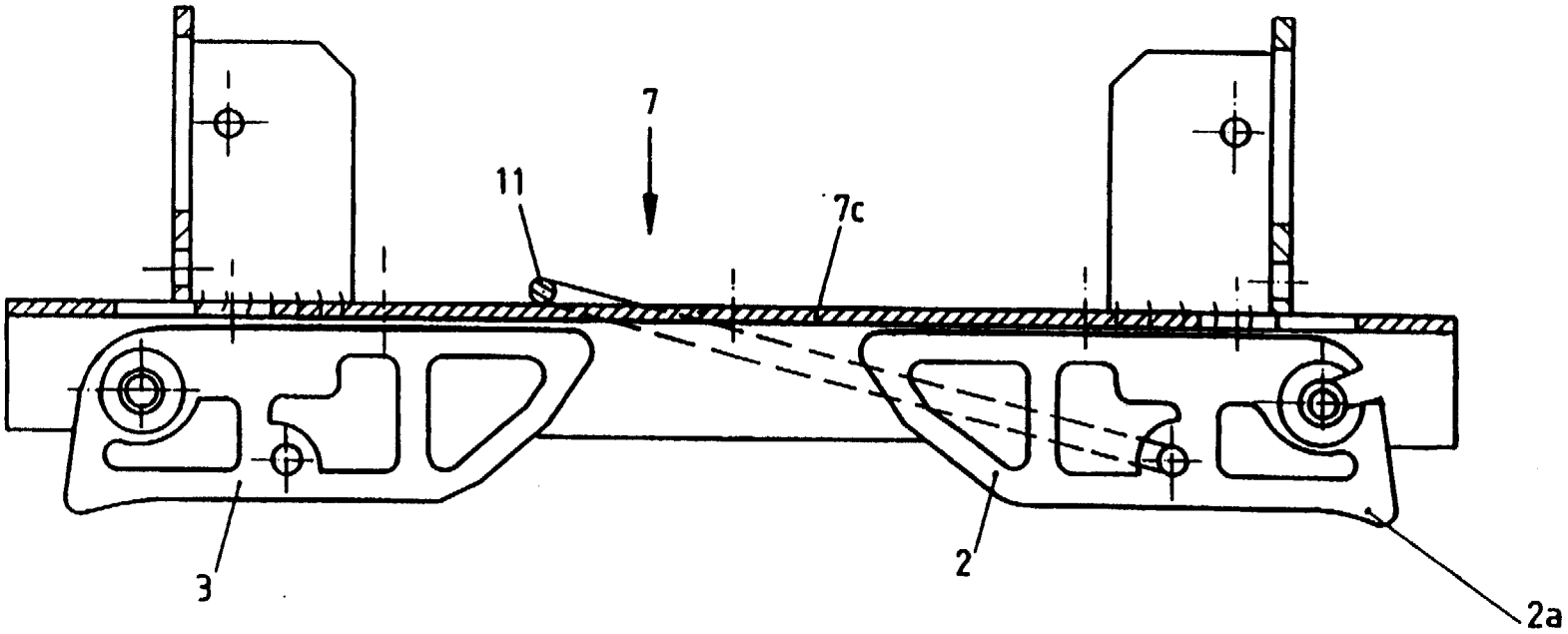
FIG. 3 is a longitudinal cross-section of the drive element of FIG. 1 with the driver and the brake claw swung upward.

In order to be able to place the conveyor carriages 1 on the track, it is necessary to bring drive element 7 out of engagement with conveyor carriage 1. For this purpose, brake claw 3 and driver 2 can be swung upward. The two parts 2, 3 are therefore—as shown in FIG. 3—swingable opposite their direction of action, i.e. in the direction of the center (vertical axis) of drive element 7. For this purpose, a horizontal hole 9 (FIG. 2) is formed outside the imaginary center line on the ends of the two parts 2, 3 which face drive element 7 in the active position. A pin 12 is placed through this hole 9 and is mounted between the side cheeks *7a*, *7b* of drive element 7.

By this eccentric arrangement of brake claw 3 and driver 2, swingability in the direction of the narrower part of the eccentricity is permitted. Swinging in the opposite direction is prevented by the end of brake claw 3 or driver 2 striking against the inner side *7c* of drive element 7. For this purpose, the upper end of driver 2 in active position is developed asymmetrically—as clearly shown in FIG. 1—so that the edge *2a* (FIG. 4) pointing in the prohibited direction of swing rests against the inner side *7c* of drive element 7. Brake claw 3 may be, as shown, basically of identical development as driver 2, being merely installed with front and rear sides reversed.

The end of driver 2 associated with inner side *7c* of drive element 7 in the active position has a groove 10 which radially intersects the hole 9 (more simply expressed, the hole 9 is slit). The width B of the groove 10 is smaller than the diameter D of the hole 9. With a force acting on the driver 2 in direction opposite the direction of transport T, if the force resulting on the pin 12 exceeds a certain value, the groove 10 is widened and the driver 2 jumps off the pin 12. For this, the difference between the width B of the groove 10 and the diameter D of the hole 9 must be selected so that the force on driver 2 which will cause driver 2 to leave pin 12 must always be greater than the maximum resultant force acting on the driver from the weight of the loaded conveyor carriage 1 during ascending travel.

For reasons of safety, the brake claw 3 does not have a corresponding groove.

In order to prevent driver 2 which has been dismounted by a blocked conveyor carriage 1 from doing damage in the vicinity, another horizontal passage hole 22 is provided in driver 2, into both sides of which hole the open ends of a U-bent wire bow 11 are inserted. The closed end of wire bow 11 lies between carrier yokes 18 on the top of the drive element. A driver 2 which is pulled off of pin 12 accordingly remains hanging on wire bow 11. Drive element 7 can then be driven unimpeded by drive chain 5 and driver 2 will evade roller 13 of conveyor carriage 1.

As can be noted from FIG. 4, pushers 23 can furthermore be fastened to drive chain 5, one being arranged behind each conveyor carriage 1 as seen in the direction of transport T. These pushers 23 serve to push a conveyor carriage 1 which is to be moved from the track into a side line at any one of the branching points (not shown here) of the conveyor path (switches). A pusher claw 24 can be developed in the same manner as driver claw 2 which has been described above. In this way, it is assured that damage to pusher 23 is effectively prevented when a conveyor carriage which has been removed from the main track strikes against an obstacle in the branching conveyor line but has not yet been completely transported out of the main conveyor line. Furthermore, in this way, it is assured that if driver 2 is pressed in accordance with its function out of drive element 7 and revolving conveyor chain 5 is not stopped immediately, pusher 23 arranged behind the conveyor carriage, and pusher claw 24, will not be damaged. Pusher claw 24 should, accordingly, be developed also in accordance with the invention.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An overhead conveyor system having rail-guided load carriers which travel on rollers, the system comprising:

a drive;

a main track; and a driver linked to the drive via a drive element, the driver having a direction of transport, the driver also having an active position in which the driver can engage a conveyor carriage for moving the conveyor carriage along the main track; the driver being mounted on the drive element by a pin on the drive element which extends through a hole in the driver, the pin and the hole being transverse to the direction of transport; the driver being pivotally mounted on the drive element for being swingable out of the active position in the direction of transport and being substantially rigid in a direction opposite to the direction of transport; the conveyor system further having a releasing arrangement permitting the driver to disengage from the drive element when acted upon by a predetermined excessive force acting in the direction opposite to the direction of transport, the release arrangement comprising a slot formed in the driver parallel to the hole, the slot being narrower than the hole so as to retain the pin in the hole except when the driver is acted upon by the predetermined excessive force.

2. A system according to claim 1, wherein the slot faces the drive element in the active position of the driver.

3. A system according to claim 2, wherein the driver further has a pivot edge which engages the drive element in the active position, such that the predetermined active force pivots the driver about the pivot edge as the pin is disengaged from the driver through the slot.

4. A system according to claim 3, wherein the hole and the pivot edge are both eccentrically disposed with respect to a center line of the driver.

5. A system according to claim 1, further comprising a safety for retaining the driver on the drive element after the driver has been disengaged from the active position by the predetermined force acting upon the driver.

6. A system according to claim 5, wherein the safety comprises a wire secured to the driver and engaging a portion of the drive element.

7. A system according to claim 1, further comprising a pusher linked to the drive behind the drive element, the pusher having a pusher claw arranged for pushing a conveyor carriage off of the main track onto a branch track, the conveyor system having a releasing arrangement permitting the pusher claw to disengage from the pusher when acted upon by the predetermined excessive force acting in the direction opposite to the direction of transport.

8. A system according to claim 7, wherein the pusher claw is mounted on the pusher by a pin on the pusher which extends through a hole in the pusher claw, the pin and hole being transverse to the direction of transport, and the release arrangement comprises a slot formed in the pusher claw parallel to the hole, the slot being narrower than the hole so as to retain the pin in the hole except when the pusher claw is acted upon by the predetermined force.

9. An overhead conveyor system having rail-guided load carriers which travel on rollers, the system comprising:

a drive;

a track; and a driver linked to the drive by a drive element, the driver having a direction of transport, the driver also having a hole therethrough, the hole having a horizontal axis transverse to the direction of transport, the driver having an active position in which the driver engages a conveyor carriage for moving the conveyor carriage along the track; the driver having a pin being received in the hole such that the driver is pivotally mounted on the drive element for being swingable out of the active position in the direction of transport and being substantially rigid in a direction opposite to the direction of transport; the conveyor system further having a releasing arrangement comprising a slot in the drive element parallel to and coextensive with the hole, the releasing arrangement permitting the driver to disengage from the drive element when acted upon by a predetermined excessive force acting on the driver in the direction opposite to the direction of transport.

10. A system according to claim 9, wherein the slot is narrower than the hole so as to retain the pin in the hole except when the driver is acted upon by the predetermined excessive force.

11. A system according to claim 9, wherein the slot faces the drive element in the active position of the driver.

12. A system according to claim 9, wherein the driver further has a pivot edge which engages the drive element in the active position, such that the predetermined active force pivots the driver about the pivot edge as the pin is disengaged from the driver through the slot.

13. A system according to claim 12, wherein the hole and the pivot edge are both eccentrically disposed with respect to a center line of the driver.

14. A system according to claim 9, further comprising a safety for retaining the driver on the drive element after the driver has been disengaged from the active position by the predetermined force acting upon the driver.

15. A system according to claim 14, wherein the safety comprises a wire secured to the driver and engaging a portion of the drive element.

16. An overhead conveyor system having rail-guided load carriers which travel on rollers, the system comprising:

a drive;

a main track; and a driver linked to the drive via a drive element, the driver having an active position in which the driver can engage a conveyor carriage for moving the conveyor carriage along the main track; the driver being pivotally mounted on the drive element for being swingable out of the active position in a direction of transport and being substantially rigid in a direction opposite to the direction of transport; the conveyor system further having a releasing arrangement permitting the driver to disengage from the drive element when acted upon by a predetermined excessive force acting in the direction opposite to the direction of transport, the system further comprising a safety for retaining the driver on the drive element after the driver has been disengaged from the active position by the predetermined force acting upon the driver, wherein the safety comprises a wire secured to the driver and engaging a portion of the drive element.

* * * * *